US006685307B2

(12) United States Patent
Dowell et al.

(10) Patent No.: US 6,685,307 B2
(45) Date of Patent: Feb. 3, 2004

(54) APPARATUS FOR PROVIDING INK TO AN INK JET PRINT HEAD

(75) Inventors: Daniel D. Dowell, Albany, OR (US); Louis Barinaga, Salem, OR (US); James P. Kearns, Corvallis, OR (US)

(73) Assignee: Hewlett-Packard Development Company L.P., Houston, TX (US)

( * ) Notice: Subject to any disclaimer, the term of this patent is extended or adjusted under 35 U.S.C. 154(b) by 0 days.

(21) Appl. No.: 10/213,817

(22) Filed: Aug. 7, 2002

(65) Prior Publication Data

US 2002/0191061 A1 Dec. 19, 2002

Related U.S. Application Data

(62) Division of application No. 09/748,059, filed on Dec. 22, 2000.

(51) Int. Cl.[7] ..... B41J 2/175

(52) U.S. Cl. ..... 347/85

(58) Field of Search ..... 347/84, 85, 86, 347/87; 137/7, 87.04, 247.13, 247.17

(56) References Cited

U.S. PATENT DOCUMENTS

| | | | | |
|---|---|---|---|---|
| 4,422,084 A | | 12/1983 | Saito | |
| 5,325,119 A | | 6/1994 | Fong | |
| 5,650,811 A | | 7/1997 | Seccombe et al. | |
| 5,719,609 A | * | 2/1998 | Hauck et al. | 347/85 |
| 5,737,001 A | | 4/1998 | Taylor | |
| 5,757,406 A | | 5/1998 | Kaplinsky et al. | |
| 5,844,577 A | | 12/1998 | Pawlowski, Jr. | |
| 5,872,584 A | | 2/1999 | Hauck et al. | |
| 5,923,353 A | | 7/1999 | Boyd et al. | |
| 5,950,659 A | * | 9/1999 | Szlaga et al. | 137/202 |
| 6,203,146 B1 | * | 3/2001 | Pawlowksi, Jr. et al. | 347/85 |

FOREIGN PATENT DOCUMENTS

| | | |
|---|---|---|
| EP | 1016433 A1 | 7/2000 |
| EP | 1055520 A1 | 11/2000 |

OTHER PUBLICATIONS

Output Hardcopy Devices, Ink–Jet Devices, Chapter 13 W.J. Lloyd and H.T. Taub Ed. R.C. Durgeck and S. Sherr, Academic Press San Diego 1988.

Askeland, et al,, "The Second–Generation Thermal Inkjet Structure," Hewlett–Packard Journal, vol. 39 No. 4, Aug. 1988, p. 28–31.

Buskrik, et al., "Development of a High–Resolution Thermal Inkjet Printhead," Hewlett–Packard Journal, vol. 39, No. 5, Oct. 1988, p. 55–61.

Kearl, et al., "Low–Cost Plain–Paper color Inkjet Printing," Hewlett–Packard Journal, vol. 42, No. 4, Aug. 1992, p. 64–68.

Mason, et al., "Automated Assembly of the HP DeskJet 500C/Desk Writer C Color Print Cartridge,"vol. 43 No. 4 Aug. 1992, p. 77–83.

(List continued on next page.)

*Primary Examiner*—Anh T. N. Vo

(57) ABSTRACT

Apparatus for providing ink to an ink jet print head. The apparatus includes a back pressure regulator for receiving ink from an ink reservoir and for delivering ink to the print head. The regulator has a compliant wall that responds to atmospheric pressure on one side and to the pressure of the ink in the regulator on the another side. Within the regulator is a valve that regulates the pressure of the ink delivered to the print head and is actuated by the wall. Also within the regulator is a compression spring that simultaneously preloads the valve shut and urges the compliant wall against the atmospheric pressure. In an other aspect, an apparatus is provided with a print head having two arrays of nozzles and two back pressure regulators that independently deliver inks of different hues to separate arrays of nozzles on the print head. In still a further aspect, the apparatus performs bi-directional ink jet color printing without hue shift through positioning the regulators and print heads with respect to the printer carriage.

5 Claims, 12 Drawing Sheets

OTHER PUBLICATIONS

Aden, et al., "The Third–Generation HP Thermal Inkjet Printhead," Hewlett–Packard Journal, vol. 45, No. 1, Feb. 1994, p. 41–45.

"Development of the HP Deskjet 1200C Print Cartridge Platform," Hewlett–Packard Journal, vol. 45, No. 1, Feb. 1994, p. 46–54.

Nielsen, Niels J., "History of ThinkJet Printhead Development," Hewlett–Packard Journal, vol. 36, No. 5, May 1985, p. 4–10.

Ozin, et al., "Zeolates: A Coordination Chemistry view of Metal–Ligand bonding in Intrazeolite MOCVD Type Precursors and Semiconductor Nanoclusters," Materials Research Society Symposium Proceedings, vol. 277, Macromolecular Host–Guest Complexes: Optical, Optoelectronic, and Photorefractive Properties and Applications, Samson A. Jenekhe, Ed., p. 105–113.

* cited by examiner

APPARATUS FOR PROVIDING INK TO AN INK JET PRINT HEAD

CROSS REFERENCE TO RELATED APPLICATION(S)

This is a divisional of copending application Ser. No. 09/748,059 filed on Dec. 22, 2000, which is hereby incorporated by reference herein.

FIELD OF INVENTION

The present invention generally relates to the field of ink jet printing and, more particularly, to the delivery of ink to ink jet print heads.

BACKGROUND OF THE INVENTION

Ink-jet technology is relatively well developed. The basics of this technology are described by W. J. Lloyd and H. T. Taub in "Ink-Jet Devices," Chapter 13 of *Output Hardcopy Devices* (Ed. R. C. Durbeck and S. Sherr, Academic Press, San Diego, 1988) and in various articles in the *Hewlett-Packard Journal*, Vol. 36, No. 5 (May 1985), Vol. 39, No. 4 (August 1988), Vol. 39, No 5. (October 1988), Vol. 43, No. 4, (August 1992), Vol.43, No. 6 (December 1992) and Vol. 45 No. 1 (February 1994).

In an effort to reduce the cost and size of ink-jet printers and to reduce the cost per printed page, engineers have developed ink-jet printers having small, moving print heads that are connected to large stationary ink reservoirs by flexible ink tubes. This development is called "off-axis" printing. In such printers the mass of the print head is sharply reduced so that the cost of the print head drive system and the over all size of the printer can be minimized. In addition, separating the ink reservoir from the print head has allowed the ink to be replaced as it is consumed without requiring frequent replacement of costly print heads.

Typically in off-axis printing systems, the ink is supplied from the reservoir under pressure to a pressure regulator located near the print head. The pressure regulator reduces the pressure of the ink and delivers the ink to the print head as required within the back pressure operating range of the print head.

One complication in the evolution of off-axis printing is the increasing need to maintain the variation in the back pressure of the ink at the print head to within as small a range as possible. Changes in back pressure greatly affect print density and print quality, and major changes in back pressure can cause the ink either to drool out of the nozzles or to de-prime the print cartridge.

There are several causes for such changes in back pressure. One cause is the inability of the pressure regulator to sufficiently follow the variations in back pressure caused by the operation of the print head. Another cause occurs when air is entrapped within the print cartridge and the print cartridge is subjected to changes in environmental parameters such as altitude, acceleration, and temperature. If the air entrapped in a print cartridge acts according to the Ideal Gas Law, PV=nRT, then any changes in any of these parameters will cause corresponding changes in back pressure.

Back pressure regulators for ink jet printers are further described in the following patents:

- U.S. Pat. No. 4,422,084 entitled "Fluid Tank and Device for Detecting Remaining Fluid" to Saito
- U.S. Pat. No. 5,650,811 entitled "Apparatus for Providing Ink to a Print Head" to Seccombe et al.

- U.S. Pat. No. 5,844,577 entitled "Back Pressure Regulator Ink Jet Pen" to Pawlowski
- U.S. Pat. No. 5,872,584 entitled "Apparatus for Providing Ink to an Ink Jet Print Head and for Compensating for Entrapped Air" to Hauck et al.

Back pressure regulators having ink bags with internal springs and fabricated from flexible film are described in the following patents:

- U.S. Pat. No. 5,325,119 entitled "Variable Rate Spring Ink Pressure Regulator for a Thermal Ink Jet Printer" to Fong
- U.S. Pat. No. 5,757,406 entitled "Negative Pressure Ink Delivery System" to Kaplisky et al.

Prior pressure regulators have been found to be too large for the new printers that are currently being developed. One recent design goal has been to reduce the size of pressure regulators by one half along the scan axis of the print head—that is, the left and right directions in which the print head scans across the printing media. In addition, it has been observed that if the pressure regulators are large, then the number of ink hues that can be accommodated in a conventional printer carriage is limited. In other words, to achieve photographic quality output, there is a need to provide at least six different ink hues in a printer in approximately the same amount of carriage space as is presently available.

However, the solution to the issue of reducing regulator size is more complex than merely scaling down prior pressure regulators. The internal mechanisms and levers in prior regulators need to be a minimum size in order to operate reliably, to achieve acceptable pressure tolerances, and to provide comparable functionality. These prior designs were found to be unusable when the dimension along the scan axis was substantially reduced.

Further, some prior pressure regulators used film bags that expand and contract in order to maintain constant back pressure to the print head. These bags are folded from sheets of film and are heat staked together. However, the edges of these bags are attacked by the ink, the layers can delaminate over time from this attack, and the print head can fail as a result.

It should be apparent from the foregoing that although there are many types of thermal ink jet back pressure regulators, there is still a need for an approach that markedly reduces the scan axis dimension while protecting the compliant film from failing by being attacked by ink and still providing the same level of regulator functionality.

SUMMARY OF THE INVENTION

Briefly and in general terms, an apparatus according to the invention includes a print head for ejecting droplets of ink on to a printing medium and a back pressure regulator for receiving ink from an ink reservoir and for delivering ink to the print head. The regulator has a compliant wall that responds to atmospheric pressure on one side and the pressure of the ink in the regulator on the another side. Within the regulator is a valve that is actuated by the wall, regulating the pressure of the ink delivered to the print head. Also within the regulator is a compression spring that simultaneously pre-loads the valve shut and urges the compliant wall against the atmospheric pressure.

In another aspect of the invention, an apparatus is provided with a print head having two arrays of nozzles and two back pressure regulators that independently deliver inks of different hues to separate arrays of nozzles on the print head.

An apparatus according to the invention also includes two valve assemblies. In one assembly a valve having an elongate stem, an attached disk orthogonal thereto, and an elastomeric valve seat bonded onto the disk is provided. An axle supports the valve for rotation and a valve nozzle is either blocked or unblocked by the valve seat through rotation of the valve about the axle. In the other assembly, a valve having an elongate stem and an attached elastomeric disk orthogonal thereto is provided. The assembly has a valve body having an opening through which the stem extends and a valve seat surrounding the opening. There is also a valve spring which urges the elastomeric disk against the valve seat in a sealing relationship. When the stem of the valve is actuated, the disk pivots on a section of the valve seat and unseals another section of the valve seat.

The invention further contemplates bi-directional ink jet color printing without hue shift through positioning the regulators and print heads with respect to the printer carriage.

Other aspects and advantages of the invention will become apparent from the following detailed description, taken in conjunction with the accompanying drawings, illustrating by way of example the principles of the invention.

DESCRIPTION OF THE PREFERRED EMBODIMENT

Figure 1:
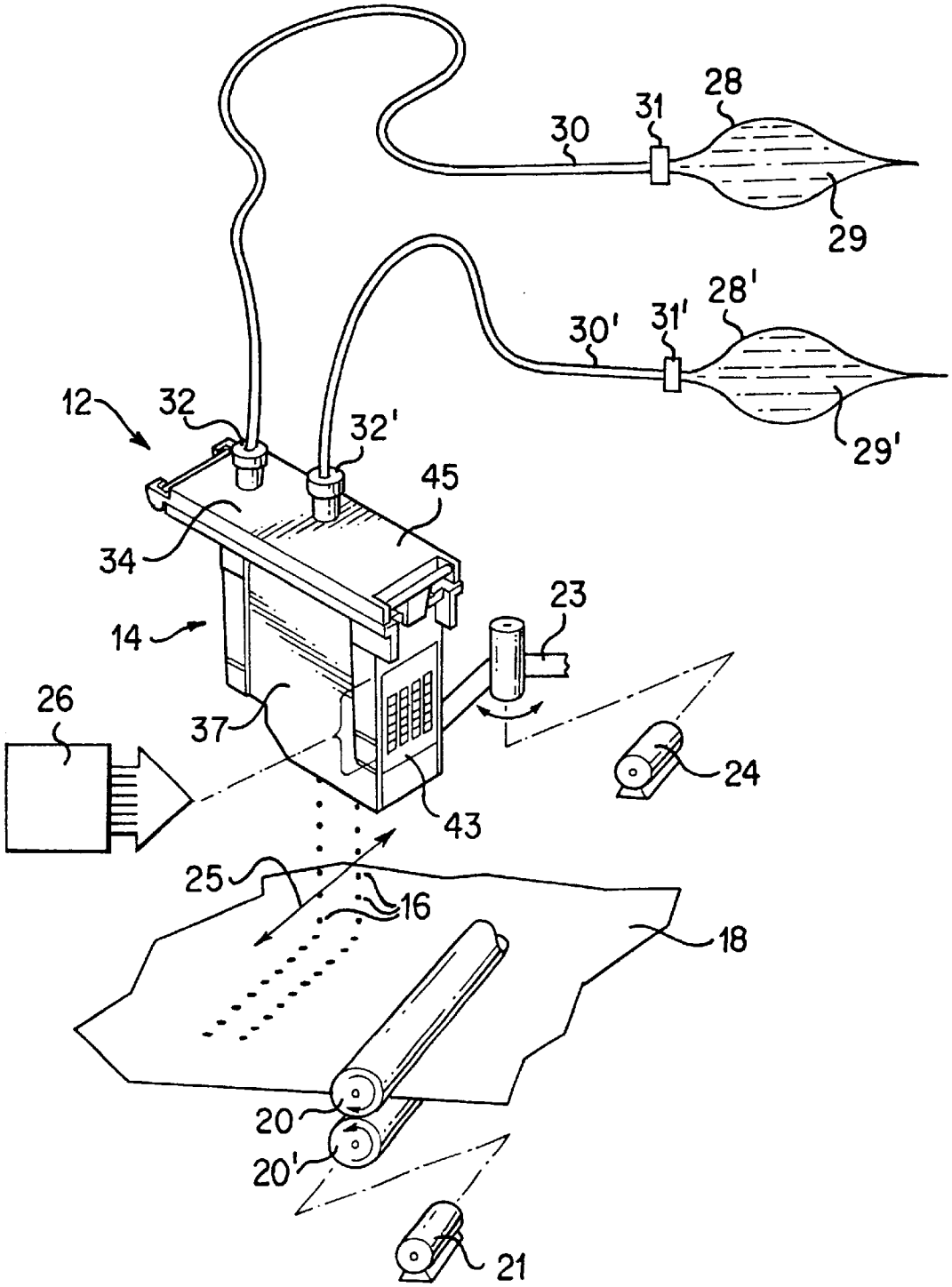
FIG. 1 is a diagrammatic view, partially in section and partially in perspective, of an ink jet printing apparatus embodying the principles of the invention.

As shown in the drawings for the purposes of illustration, the invention is embodied in an apparatus for providing ink to a print head. The apparatus includes two back pressure regulators that independently deliver inks of different hues to separate arrays of nozzles on a common print head.

Each back pressure regulator has a width along the scan axis of the print head of about half that of prior regulators. In particular, prior regulators had a width of about 13 millimeters or more; the present regulator has a width of about 6–6 ½ millimeters.

Figure 17:
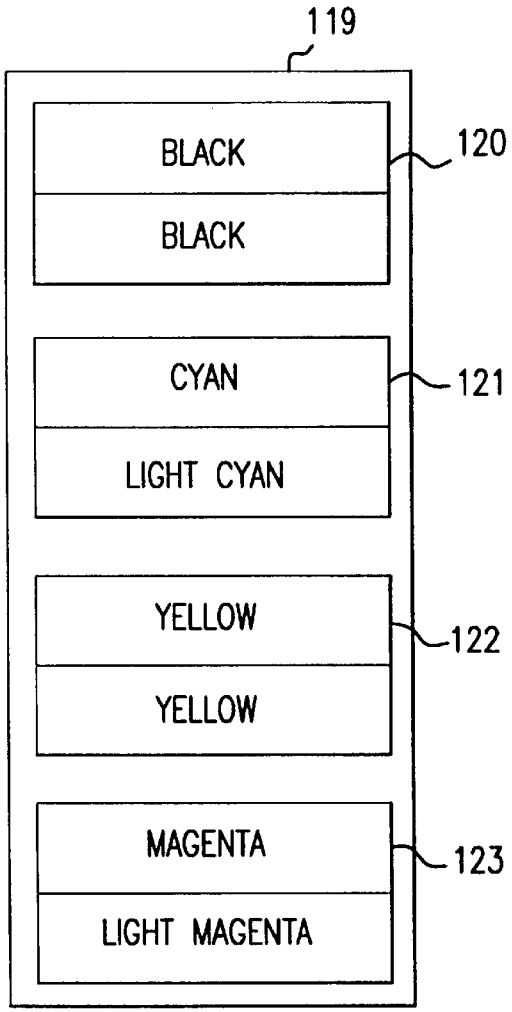

This reduction in size offers numerous advantages. First, six different inks can be delivered to only three print heads where, in the past, the same number of print heads could only accommodate four different inks. Each print head has two arrays of nozzles, and each back pressure regulator independently delivers ink to one of the arrays of nozzles. In particular, one print head could jet magenta and light magenta; one print head, cyan and light cyan; one print head solely yellow; and one print head solely black. If six different ink hues can be provided in the same amount of carriage space previously required for four inks, then photographic quality images may be attainable. Further, this apparatus permits much more functionality, i.e., larger and more varied ink sets, in a printer of about the same size as prior printers. This configuration is illustrated in FIG. 17.

Figure 18:
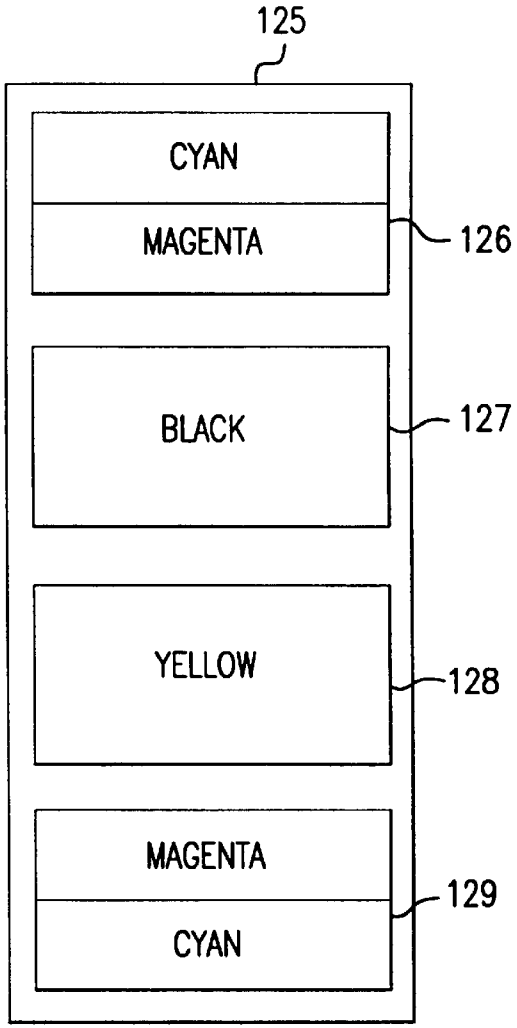
FIGS. 16, 17, 18, and 19 are diagrammatic views of various back pressure regulator/print head configurations within various printer carriages.

A second advantage of this reduction in pressure regulator size is the ability to print color images bi-directionally without hue shift. Bi-directional printing by itself produces a two-fold increase in printer output speed. In prior ink jet printers, high quality color images could only be printed in one scan direction because the order in which the droplets are set down on the printing media must be maintained. If the order of droplets is not maintained, then a visible shift in hue results between each pass of the carriage. For example, if a printer carriage contains black, cyan, yellow, and magenta print heads located from left to right, then when the carriage is scanned from right to left cyan droplets are jetted first, then yellow and finally magenta. If the carriage is scanned in the reverse direction from left to right, magenta droplets are jetted first, followed by yellow, and cyan last. The configuration of regulators/print heads for bi-directional color printing is illustrated in FIG. 18.

Figure 16:
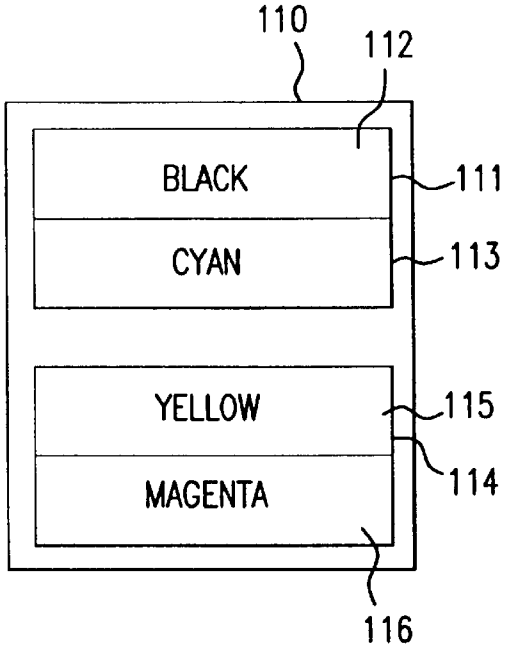

Still another advantage of reducing regulator size is the reduction in system cost. With the present apparatus two inks of different hues can be delivered and jetted by one print head. So a four ink printer needs only two print heads. In addition, such a printer is smaller in over all size and has the same functionality as prior four ink printers. This regulator/print head configuration is illustrated in FIG. 16.

Referring to FIG. 1, reference numeral 12 generally indicates a printer including a print cartridge 14 that ejects drops 16 of ink on command. The drops form images on a printing medium 18 such as paper. The printing medium is moved laterally with respect to the print cartridge 14 by two print rollers 20, 20' and a motor 21 that engages the printing medium. The print cartridge is moved back and forth across the printing medium by a drive belt 23 and a motor 24. The motion of the print cartridge caused by the drive belt 23 and the motor 24 defines the scan axis 25. The print cartridge contains a plurality of firing resistors, not shown, that are energized on command by an electrical circuit 26. The circuit sequentially energizes the firing resistors in a manner so that as the print cartridge 14 moves laterally across the paper and the paper is moved by the rollers 20, 20', the drops 16 form images on the printing medium 18.

In FIG. 1, there are two ink reservoirs 28, 28' that are flaccid bags that each contain ink 29, 29'. Although not required, the ink 29, 29' in each bag may be pressurized up to a level of +100 inches of water for delivery to the print cartridge 14. The ink reservoirs 28, 28' are each connected to a conduit of flexible tubing 30, 30' by a fluid interconnect 31, 31'. The tubing 30, 30' terminates at a fluid interconnect 32, 32' located on the print cartridge 14. Thus, fluid communication is established between the ink reservoirs 28, 28' and the print cartridge 14.

Figure 2:
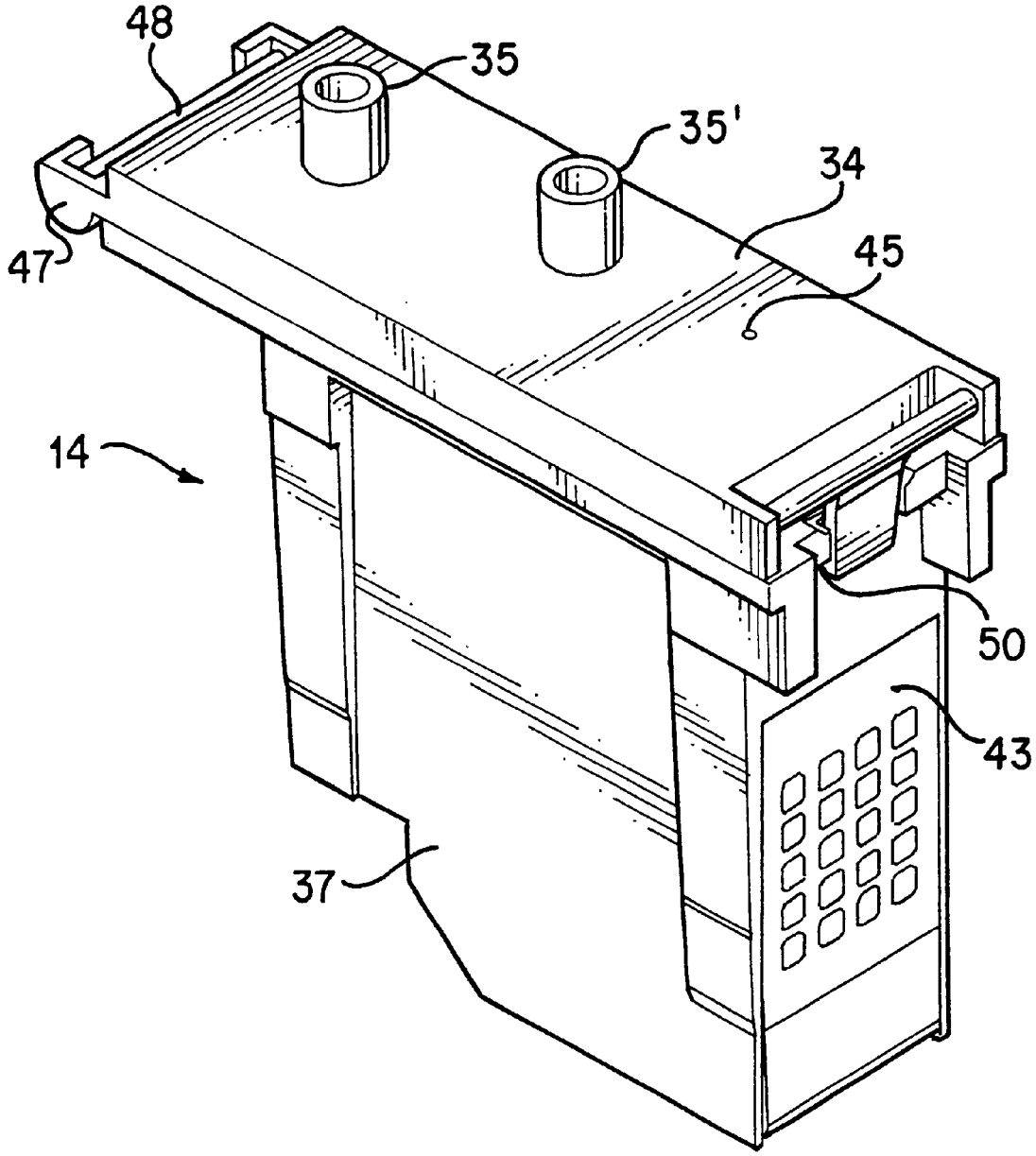
FIG. 2 is a perspective view from above of the print cartridge of FIG. 1.

Referring to FIG. 2, reference numeral 34 indicates a fluid interconnect plate that contains two ink inlet ports 35, 35'. The fluid interconnects 32, 32', FIG. 1, and the tubing 30, 30' attach to these ports. The fluid interconnect plate is rigid and formed from a polymer material such as liquid-crystal polymer (LCP) available from Ticona, Inc. of Summit, N.J. The fluid interconnect plate as well as all of the LCP parts comprising the print cartridge 14 are formed by conventional injection molding techniques. The function of the fluid interconnect plate 34 is to route the ink into the regulator housing as described in detail below.

Figure 3:
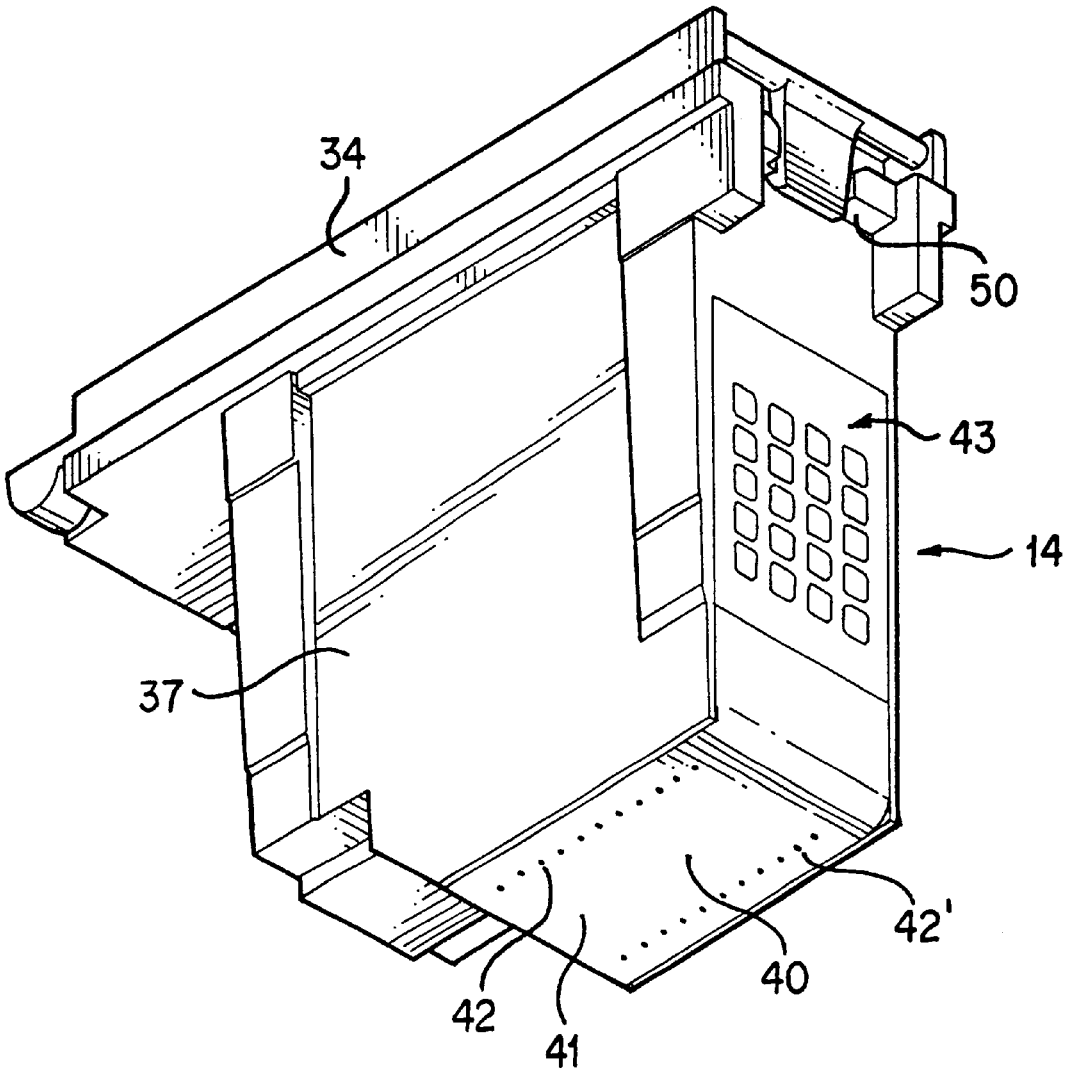
FIG. 3 is a perspective view from below of the print cartridge of FIG. 1.

The print cartridge 14, FIGS. 2 and 3, further includes a body 37 which is a housing that contains two pressure regulators in an abutting relationship, i.e., sharing a common wall, and a nozzle plate 40, FIG. 3, of a thermal ink jet print head 41. The body 37 is rigid and fabricated from LCP, and the print head 41 is of conventional construction. The nozzle plate 40 has two arrays of nozzles 42, 42' and each array is separately connected to one of the pressure regulators so that ink from one pressure regulator is jetted from one array of nozzles and ink from the other pressure regulator is jetted from the other array. Also located on the body 37 is a TAB circuit 43 that serves as the electrical interconnect between the print cartridge 14, FIG. 1 and the electrical circuit 26, FIG. 1. The TAB circuit 43 is of conventional construction and allows the printer 12, FIG. 1 to fire the print cartridge 14 by sending electrical pulses to the firing resistors (not shown).

Figure 5:
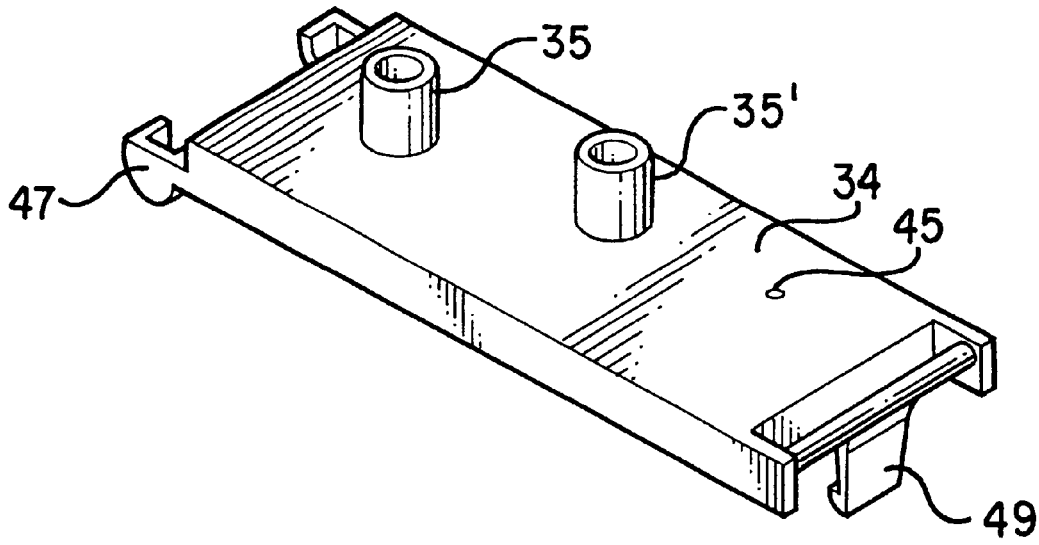
FIG. 5 is a perspective view from above of the fluid interconnect plate of the back pressure regulator of FIG. 4.
Figure 6:
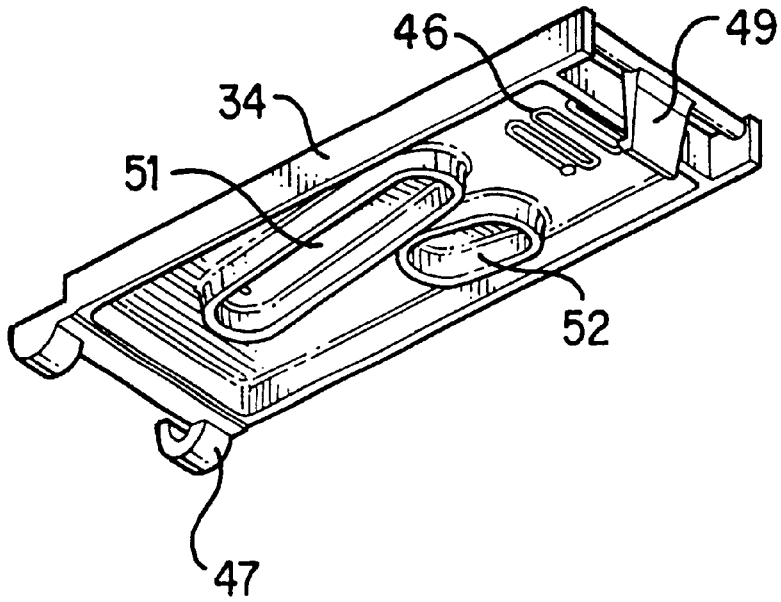
FIG. 6 is a perspective view from below of the fluid interconnect plate of the back pressure regulator of FIG. 4.

Referring to FIGS. 5 and 6, the fluid interconnect plate 34 contains a labyrinth hole 45 that connects to a labyrinth 46, FIG. 6. The labyrinth hole and the labyrinth allow air at atmospheric pressure to enter the inside of the body 37 while limiting the loss of water vapor from the print cartridge 14.

In FIGS. 5 and 6, reference numeral 47 indicates a snap yoke that is located at one end of the fluid interconnect plate 34. The snap yoke 47 engages a snap axle 48, FIGS. 2 and 4, mounted on the body 37. When the snap axle 48 receives the snap yoke, the fluid interconnect plate 34 is able to rotate around the snap axle 48, making assembly of the print cartridge less complex and easier. Opposite the snap yoke 47 on the fluid interconnect plate 34 is a snap hook 49. When the fluid interconnect plate 34 rotates about the snap axle 48, the snap hook 49 engages and locks on a snap lip 50 located on the wall of the body 37 as illustrated in FIGS. 2 and 3. This also makes assembly of the print cartridge less complex and easier.

On the bottom side of the fluid interconnect plate 34, FIG. 6, are two ink channels 51, 52, that route the ink from the ink inlet ports 35, 35', FIG. 5 to the two pressure regulators described in detail below.

Figure 4:
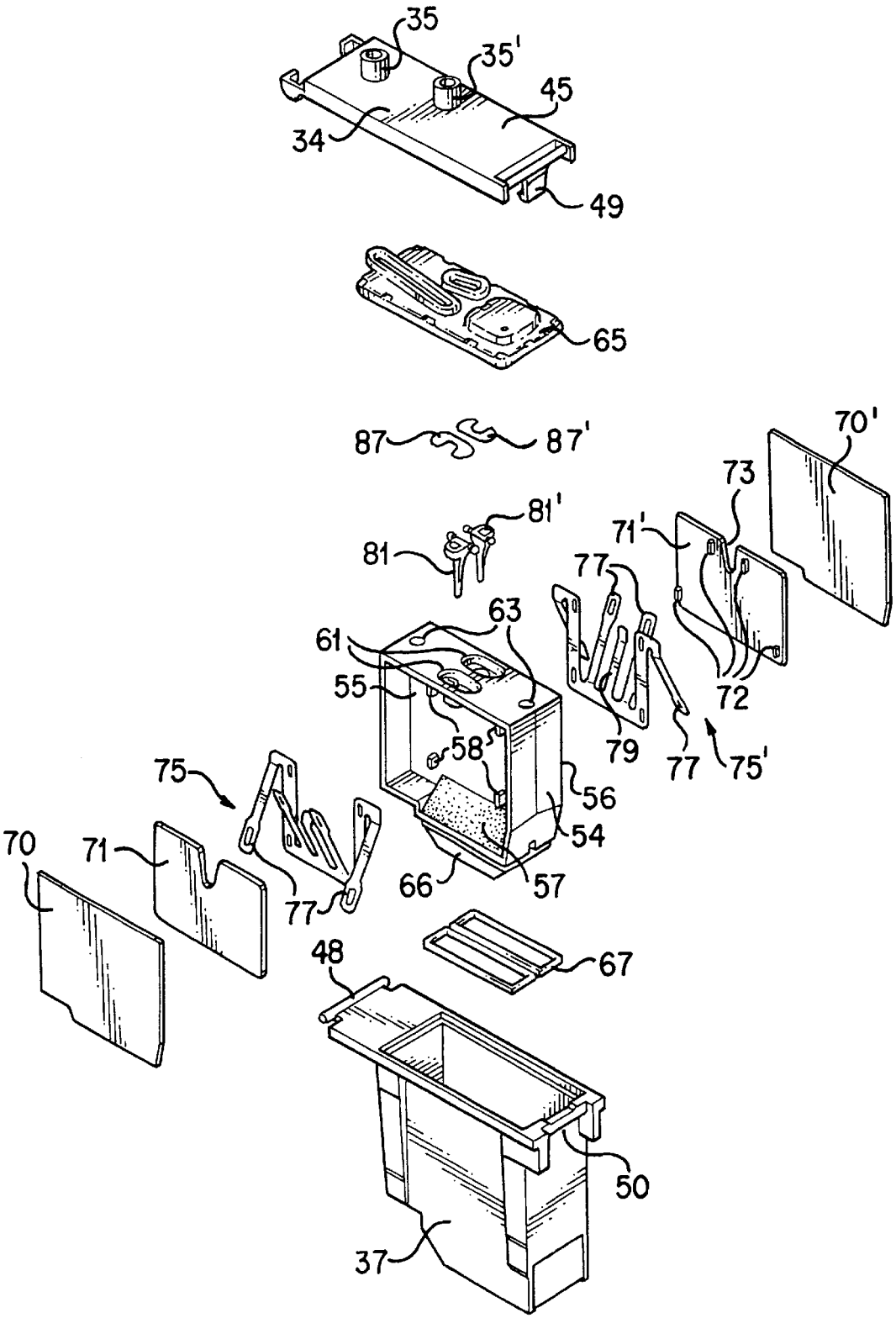
FIG. 4 is an exploded view of the print cartridge of FIG. 1.
Figure 9:
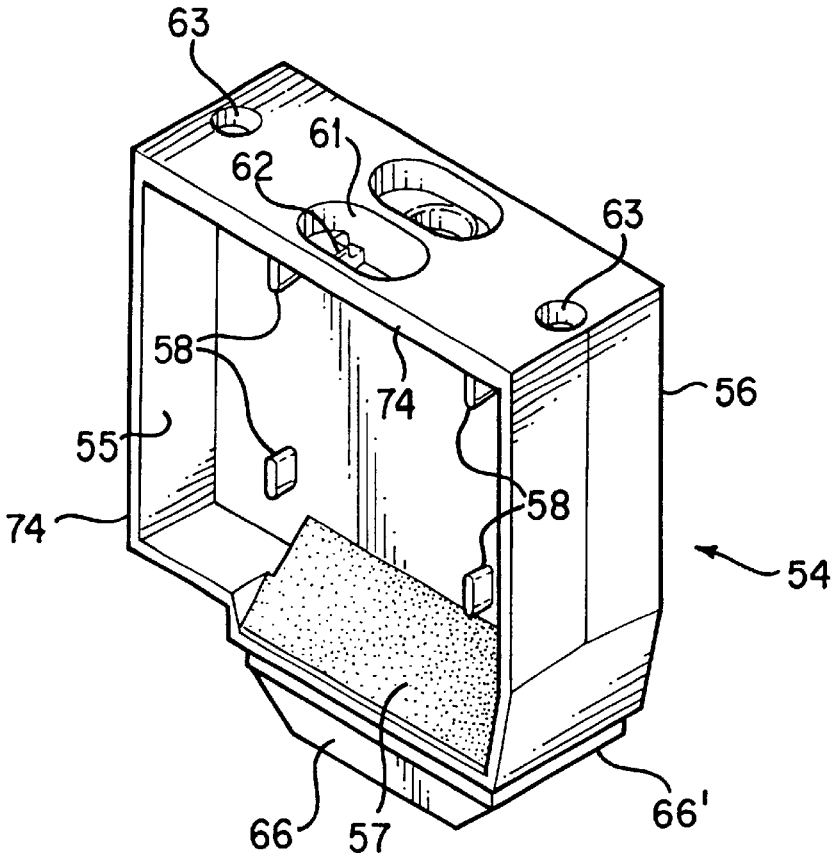
FIG. 9 is a perspective view from above of the regulator housing of the back pressure regulator of FIG. 4.

Referring to FIGS. 4 and 9, reference numeral 54 generally indicates a regulator housing that is received in the body 37, FIG. 4. The regulator housing is fabricated from polyethylene by conventional molding techniques and, when fully assembled, forms two pressure regulators located side by side (an abutting relationship) and sharing a common, central wall. Both pressure regulators are constructed, assembled, and operate in the same manner except one is a mirror image of the other. Thus, for brevity only one pressure regulator need be described.

Within the regulator cavity 55, FIG. 9 is a filter 57 fabricated from a sintered metal. The filter removes any particles from the ink before the ink reaches the print head 41, FIG. 3 and prevents the print cartridge 14 from becoming clogged with debris. Also located in the regulator cavity 55 are four swage posts 58 which are protruding features molded in the common, central wall of the housing 54. The regulation spring 75, FIG. 12 has four common mounting apertures 76 that are slipped over these posts 58 during assembly and thereafter a heated tool mushrooms each post over each aperture on the spring, locking the regulation spring 75 in place in the regulator cavity 55.

Located in the top wall of the regulator cavity 55, FIG. 9 is a valve pocket 61. The valve pocket receives the ink inlet valve 81, FIG. 10 during assembly and the inlet valve is supported for rotation during operation of the regulator on two valve yokes 62 located within the valve pocket. There is only one valve yoke 62 that can be seen in FIG. 9, but each valve pocket 61 contains two. Each valve yoke 62 is a three sided, upward facing, U-shaped feature. Also located on the top wall of the regulator cavity 55 are two alignment holes 63 that register the inlet manifold 65, FIG. 4, during assembly as described in detail below.

Referring to FIG. 9, in the bottom of the regulator housing 54 are two outlets 66. Each outlet delivers filtered ink to a fluidically separated section of the print head 41, FIG. 3 for jetting. One outlet connects to one array of nozzles 42, and the other outlet connects to the other array of nozzles 42'. Located around each outlet 66 is a stand pipe gasket 67, FIG. 4. When the regulator housing 54 is slipped into the body 37, a stand pipe is formed between the outlet 66 and the inside walls of the body 37. The gasket 67 seals the stand pipe.

Referring to FIG. 4, reference numeral 70 indicates an viscoelastic, deformable, multi-layer film fabricated from polyethylene and saran. The margin of the film is heat staked onto and completely around the narrow peripheral rim 74, FIG. 9 of the regulator cavity 55. This method of staking shields the edges of the film from chemical attack by the ink over the life of the print cartridge because the ink is only exposed to the interface between the rim 74 of the cavity and the unstaked inner margin of the film. The film is staked into place with some slack so that the film can collapse and expand in response to the differential pressure across its surface, thereby producing a compliant wall. During operation of the print cartridge 14, ambient air at atmospheric pressure is present on the outside of the regulator housing 54, on the outside surface of the film 70, and on the inside of the body 37, FIG. 4. The source of this air is the labyrinth hole 45 and the labyrinth 46 in the fluid interconnect plate 34, FIGS. 5 and 6. Within the regulator 55 itself and on the inside surface of the film 70, the ink is maintained at a slightly negative pressure due to the operation of the regulator and to the jetting of ink out of the print cartridge 14 by the print head 41, FIG. 3. The negative pressure in the regulator is in a range of about one inch of water to fifteen inches of water.

Figure 12:
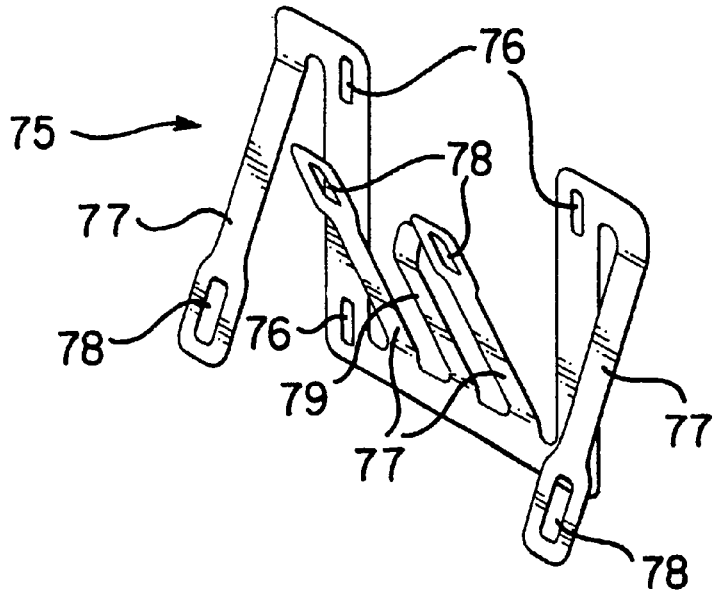
FIG. 12 is a perspective view from above of the regulation spring of the back pressure regulator of FIG. 4.
Figure 13:
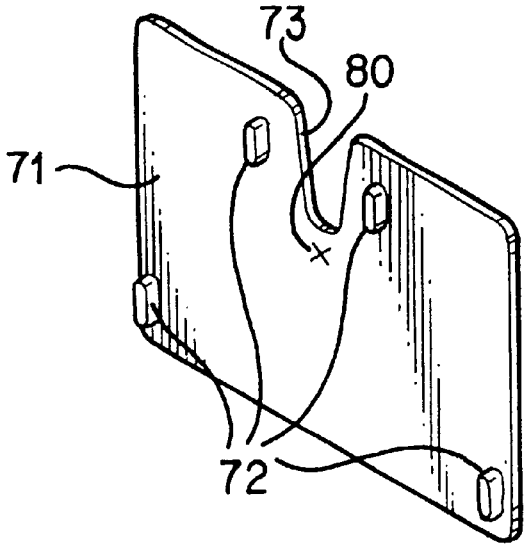
FIG. 13 is a perspective view from above of the pressure plate of the back pressure regulator of FIG. 1.

In FIGS. 4 and 13, reference numeral 71 indicates a pressure plate that is a rigid plastic part. As illustrated in FIG. 13, there are four locating posts 72 on the inner side of each pressure plate. These posts 72 engage the regulation spring 75, FIG. 12, and register the pressure plate with respect to the spring as described in detail below. The film 70 bears against the pressure plate 71 and the pressure plate moves with the film 70 as it contracts and expands in response to the differential pressure developed across the surface of the film 70. Further, the pressure plate includes a U-shaped notch 73 which permits the pressure plate 71 to contact the ink inlet valve 81, FIG. 10, only at the lower portion of the valve stem 82. The basal surface 80 of the U-shaped notch 73 is the contact point of the valve stem. The function of the U-shaped notch 73 is to obtain more mechanical advantage on the ink inlet valve by the pressure plate.

Referring to FIG. 12, reference numeral 75 generally indicates a regulation spring that is a stamped, stainless steel part. The regulation spring 75 has four mounting apertures 76 that receive the swage posts 58 located on the common wall of the regulator cavity 55. During assembly the mounting apertures are slipped over the posts 58 and a heated tool, not shown, mushrooms the posts down over the regulation spring 75, locking and mounting the spring in the regulator cavity 55. Further, the regulation spring 75 has four regulation arms 77 that are each resiliently and elastically deformable and each compresses against the inward motion of the pressure plate 71, FIG. 13. Each regulation arm 77 has an elongate regulation aperture 78 that receives one of the locating posts 72 on the pressure plate 71, FIG. 13. The locating posts 72, however, are not swage posts. The locating posts 72 slide back and forth in the elongate regulation apertures 78 as the pressure plate 71 resiliently compresses and expands the regulation spring 75. One function of the regulation spring 75 is to oppose the differential pressure developed across the film 70 and to urge the pressure plate 71 and in turn the film 70 outwardly against the ambient atmospheric air pressure on the outside of the regulator housing 54 and inside the body 37.

In FIG. 12, the regulation spring 75 also includes a pre-load arm 79 that is resiliently and elastically deformable and acts in compression. The pre-load arm 79 biases the ink inlet valve 81, FIG. 10 shut when additional ink is not needed in the regulator 55. This is the second function of the regulation spring 75 and occurs simultaneously while the regulation arms 77 urge the pressure plate 71 and the film 70 outward.

Figure 10:
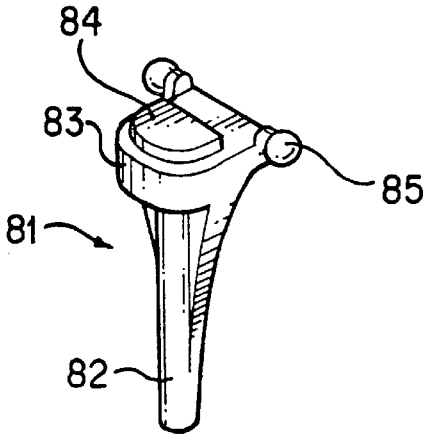
FIG. 10 is a perspective view from above of the valve assembly of the back pressure regulator of FIG. 4.

Referring to FIG. 10, reference numeral 81 generally indicates an ink inlet valve for the regulator. The ink inlet valve includes a rigid plastic part having the features described immediately below with an elastomeric portion overmolded thereon. The inlet valve has a rigid, elongate valve stem 82 which is an elongate portion of the valve that is continuously engaged by the pre-load arm 79 of the regulation spring 75, FIG. 12. The valve stem is also intermittently engaged by the pressure plate 71, FIG. 13 to admit ink into the pressure regulator cavity 55. The pressure plate and valve stem are not mechanically coupled; thus they can be operatively disengaged when the inlet valve is shut. This feature allows for compensation for any air entrapped in the pressure regulator. The inlet valve 81 further includes a valve seat pocket 83 rigidly formed with the valve stem 82. The valve seat pocket is orthogonal to the longitudinal axis of the valve stem 82. Bonded to the upper surface of the valve seat pocket 83 is an elastomeric, resiliently deformable valve seat 84. The valve seat is fabricated from silicone rubber. The valve seat seals and unseals a valve nozzle 86, FIG. 8 and allows ink to enter the regulator cavity 55 as needed to maintain the pressure of the ink delivered to the print head. The inlet valve also includes a valve axle 85, that along with the valve stem 82 and the valve seat pocket 83, forms one rigid unitary plastic part. The valve axle 85 has a longitudinal axis that is parallel to a tangent of the valve seat pocket 83 and is mounted for rotation on the two valve yokes 62, FIG. 9 in the valve pocket 61 of the regulator housing 54. Contact with the pre-load arm 79 of the regulation spring 75 and with the pressure plate 71, FIG. 13, causes the inlet valve 81 to rotate about the valve axle 85 and the valve seat 84 to block and unblock the valve nozzle 76, FIG. 8. In operation, the inlet valve 81 rocks back and forth in the valve pocket 61 of the regulator housing 54, FIG. 9.

It should be appreciated that the U-shaped notch 73 in the pressure plate 71, FIG. 13 functions so that the pressure plate will only engage the valve stem 82, FIG. 10 at the far, remote end of the stem. This produces more mechanical advantage on the valve for actuation and insures that the lever arm length of the valve stem 82 is maximized.

It should further be appreciated that the valve seat pocket 83 and the valve seat 84 need not be orthogonal to the longitudinal axis of the valve stem 82 nor the valve axle 85 need be parallel to a tangent of the valve seat pocket 83 as long as the inlet valve 81 substantially functions as described above.

Figure 11:
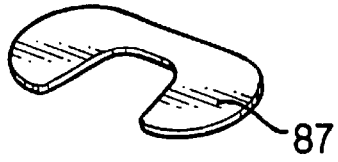
FIG. 11 is a perspective view from above of the axle retention plate of the back pressure regulator of FIG. 4.

The inlet valve 81, FIG. 10 is retained in the valve pocket 61, FIG. 9, in the regulator housing 54 by an axle retention plate 87, FIG. 11. The axle retention plate is fabricated from stainless steel sheet and functions as a fourth wall to the valve pocket yokes 62, FIG. 9, described in detail above. Thus, the valve axle 85, FIG. 10 is captured and permitted to rotate in the valve pocket 61.

Figure 7:
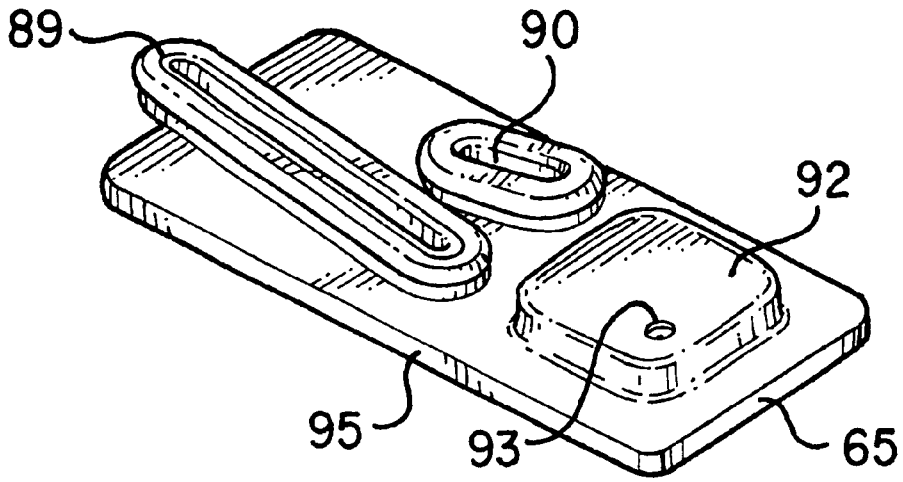
FIG. 7 is a perspective view from above of the inlet manifold of the back pressure regulator of FIG. 4.
Figure 8:
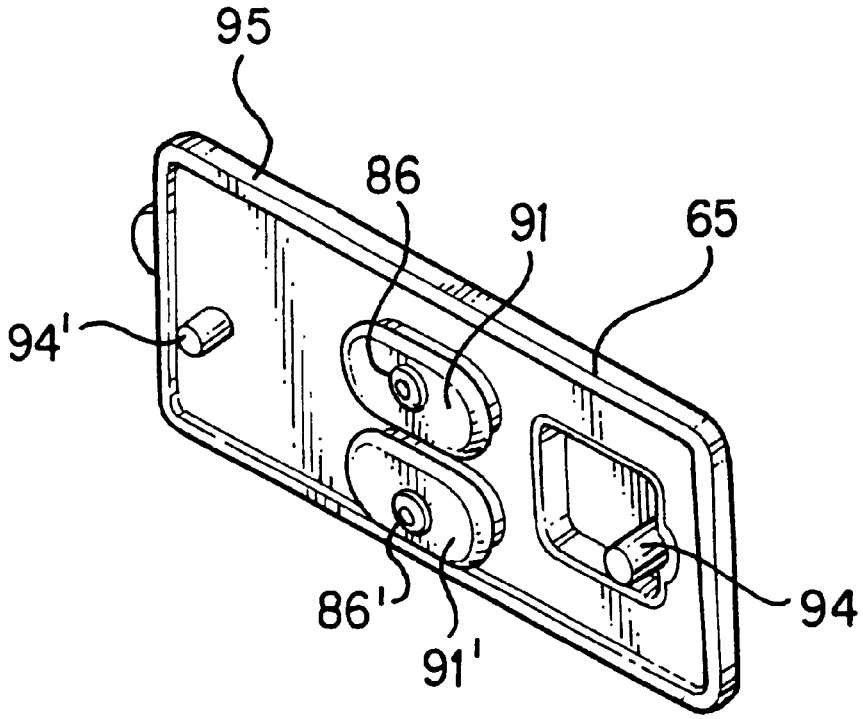
FIG. 8 is a perspective view from below of the inlet manifold of the back pressure regulator of FIG. 4.

Referring to FIGS. 7 and 8, reference numeral 65 generally indicates an inlet manifold that ducts the ink from the inlet ports 35, 35', FIG. 4 to the inlet valves 81, 81', FIG. 4. The inlet manifold is fabricated from a rigid plastic substrate (LCP) and is over-molded with silicone rubber so that six fluidic seals are formed with the fluid interconnect plate 34, FIG. 6. In particular, the inlet manifold 65 has two ink channels 89, 90 with raised walls. A gland seal is molded on the outside of each wall. These two gland seals seal within the respective ink channels 51, 52 on the fluid interconnect plate 34 as illustrated in FIG. 6. The ink channels 89, 90 communicate with the valve nozzles 86, 86' located on two valve bosses 91, 91', FIG. 8. The valve nozzles 86, 86' are blocked and unblocked by the rocking motion of the inlet valves 81, 81', FIG. 4. This rocking motion causes ink to flow or not to flow into the regulator cavities 55, 56 as needed. In addition, the inlet manifold 65 includes a labyrinth wall 92 that provides a floor for the labyrinth 46 located in the fluid interconnect plate 34, FIG. 6. This is a fifth fluidic seal. The labyrinth communicates with a labyrinth hole 93 located in the inlet manifold 65. The labyrinth permits air at atmospheric pressure to surround the outside of the two regulators and retards moisture from escaping from the print cartridge. The inlet manifold 65 further includes two assembly posts 94, 94° FIG. 8 that are received in the alignment holes 63, 63' on the regulator housing 54, FIG. 9 during assembly of the print cartridge. The edge 95 of the inlet manifold 65 forms a sixth fluidic seal against the side walls, i.e., the lip, of the fluid interconnect plate 34 so that any air entering or leaving the print cartridge must pass through the labyrinth 46 and not flow around the edge 95 of the inlet manifold 65.

The ink flows to and from the print cartridge along two parallel and independent flow paths. One is a mirror of the other. For brevity only one will be described. Referring to FIG. 1, the ink 29 in the ink reservoir 28 flows through the tubing 30 to the print cartridge 14 located in the printer 12. The ink enters the print cartridge 14 through the inlet port 35, FIG. 5 on the fluid interconnect plate 34. The ink thereafter flows along the ink channel 89, FIG. 7 molded in the inlet manifold 65. If the inlet valve 81, FIG. 4 associated with this ink channel is open and the valve nozzle 86, FIG. 8 is unblocked, ink flows through the valve pocket 61, FIG.

9 and into the regulator cavity 55, FIG. 9 in the regulator housing 54. Thereafter, the ink flows through the filter 57 and into the outlet 66, FIG. 9 associated with this regulator. The ink is jetted in droplets 16, FIG. 1 onto the printing medium 18 by the print head 41, FIG. 3.

Figure 14:
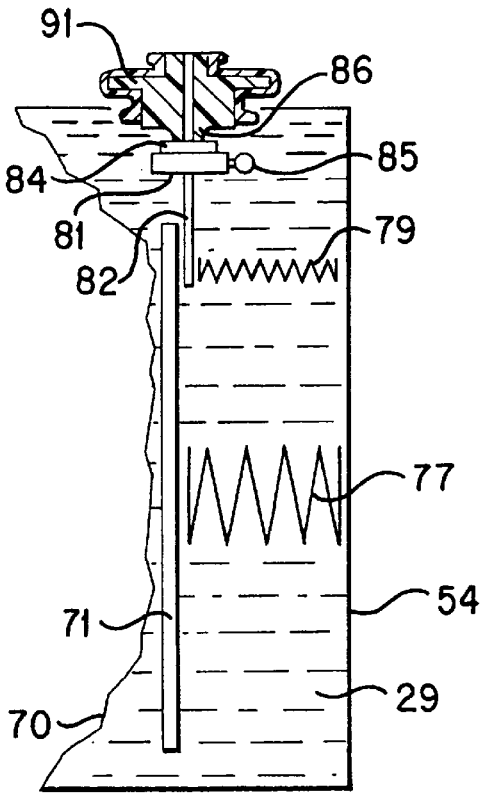
FIG. 14 is a diagrammatic view of the back pressure regulator of FIG. 1 illustrating the valve shut.
Figure 15:
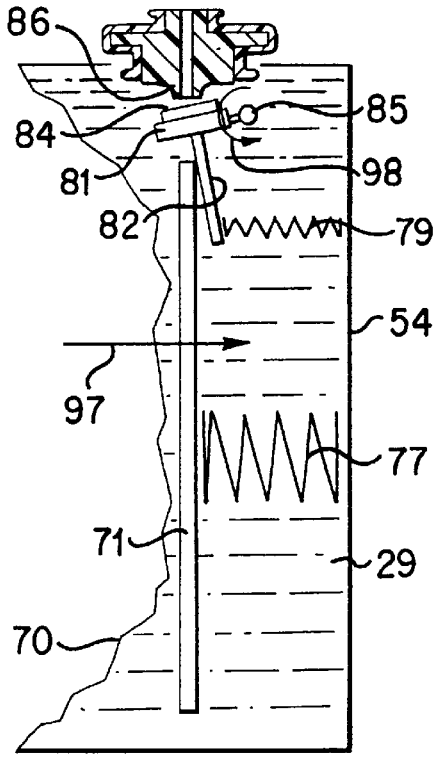
FIG. 15 is a diagrammatic view of the back pressure regulator of FIG. 1 illustrating the valve open.

The operation of the print cartridge is pictorially illustrated in FIGS. 14 and 15. Note that the regulation spring 75 illustrated in FIG. 12 has been drawn as two springs 77 and 79 in FIGS. 14 and 15 because the regulation spring has two functions—it pre-loads or biases the inlet valve 81 shut with the pre-load arm 79 and simultaneously urges the compliant wall 70 with the pressure plate 71 against the atmospheric air pressure surrounding the outside of the regulator housing 54.

In FIG. 14 the pressure regulator is at steady state and ready to operate. This is the usual condition of the print cartridge. The pressure regulator is filled with ink 29 and the ink is at a negative pressure of about three and one half inches of water. The regulation spring/arm 77 is urging the pressure plate 71 against the film 70. The outside of the regulator and the exterior surface of the compliant wall 70 are at ambient pressure. The pre-load spring/arm 79 is urging the inlet valve 81 shut so that the valve nozzle 86 on the valve boss 91 is blocked.

On command, the printer 12, FIG. 1 starts to print and the print head 41, FIG. 3 fires in the conventional manner so that droplets 16 of ink are jetted onto the printing medium 18. This jetting of ink by the print head 41 causes the pressure in the regulator to decrease. In turn the ambient air pressure forces the film 70 and pressure plate 71 back against the regulation spring/arm 77. In effect, the film collapses against the regulation spring due to the differential pressure across the compliant wall 70. This motion is indicated by the arrow 97, FIG. 15.

The pressure in the regulator continues to decrease as the print head 41 jets ink until the basal surface of the notch 73, FIG. 13 on pressure plate 71 contacts the valve stem 82 on the inlet valve 81. The pressure plate over comes the urging of the pre-load arm/spring 79 and the basal surface of the notch 73 causes the inlet valve 81 to rotate about the valve axle 85, to move the valve seat 84 away from the valve nozzle 86, and to unblock the valve nozzle. This rotary motion about the valve axle is indicated by the arrow 98. Ink now flows into the regulator cavity 55, the pressure of the ink in the regulator cavity increases, and the regulator cavity returns to the condition illustrated in FIG. 14. The blocking and unblocking of the valve nozzle 86, the rocking back and forth of the inlet valve 81, and the filling of the regulator with ink are steps that are repeated over and over in order to provide ink to the back of the print head 41 at the desired operating pressure.

The valve stem 82 on the inlet valve is positioned in the regulator so the contact between the valve stem and the basal surface of the notch 73 on the pressure plate 71 only occurs after the pressure plate has displaced the regulation spring 75 by about 3.5 mm. This feature allows the print cartridge to compensate for air entrapped in the pressure regulator because the valve stem and pressure plate are not mechanically coupled together. During any expansion of entrapped air, the back pressure within the regulator decreases and the regulation spring forces the pressure plate away from the valve stem until the volume increases enough to return the regulator to equilibrium.

In FIG. 16 reference numeral 110 indicates a diagrammatic view of a printer carriage on which two print cartridges 111, 114 are mounted side by side. These print cartridges are of the type described above and illustrated in FIG. 3. The print cartridge 111 jets black ink from one pressure regulator and its associated array of nozzles identified by reference numeral 112. The adjacent pressure regulator and associated array of nozzles 113 jets cyan ink from the other array of nozzles on the same print head. Similarly, yellow ink is jetted from pressure regulator/print head 115 and magenta from 116. Thus, the printer carriage 110 carries four pressure regulators that supply inks of four different hues to only two print heads. A printer into which such a carriage is mounted has a smaller over all size and the same functionality as prior four ink printers because such prior printers required four print cartridges each of which is as large as the print cartridge 111. In other words, the prior carriage was at least twice as big as the carriage 110.

FIG. 17 is a diagrammatic view of a carriage 119 for a printer that produces very high quality images, potentially of photographic quality. Inks of six different hues are delivered to four print cartridges 120–123, inclusive and each print cartridge has one print head with two arrays of nozzles. Print cartridge 120 has two pressure regulators connected to two nozzle array that both jet black ink, likewise print cartridge 122 for yellow ink. Print cartridge 121 jets cyan and light cyan independently from each array of nozzles, likewise print cartridge 123 for magenta and light magenta. This carriage prints in only one direction due to the problem of hue shift described above. Nevertheless, the inks may be jetted from the carriage in any order and from any position.

It is also contemplated that for those print cartridges having both arrays of nozzles jetting ink of the same hue, the common wall between the two pressure regulators can be provided with an aperture so that pressure in each pressure regulator is equalized. Further, it is also contemplated for these print cartridges that the size of the ink drops jetted from one array of nozzles can be different from the ink drops jetted from the other array of nozzles, resulting in better print quality.

In FIG. 18 reference numeral 125 indicates a printer carriage that can print color in both scan directions without hue shift. The benefit of bi-directional printing is that this feature alone can double the output of a printer. In print cartridge 126 the outer most pressure regulator/array of nozzles jets cyan ink and the inner, magenta ink. Black ink is jetted from print cartridge 127 by both pressure regulators/arrays of nozzles, and likewise yellow ink from print cartridge 128. In print cartridge 129 the outer most pressure regulator/array of nozzles jets cyan ink and the inner, magenta ink. This printer carriage can print color bi-directionally because whether going from left to right or right to left, the same sequence of drops of different hues on top of one another can be maintained.

It should be appreciated that the inks in the central print cartridges 127 and 128 can be interchanged and that the inks in the outer print cartridges 126 and 129 can be interchanged with each other as well as long as the pattern of symmetry illustrated in FIG. 18 is maintained.

Figure 19:
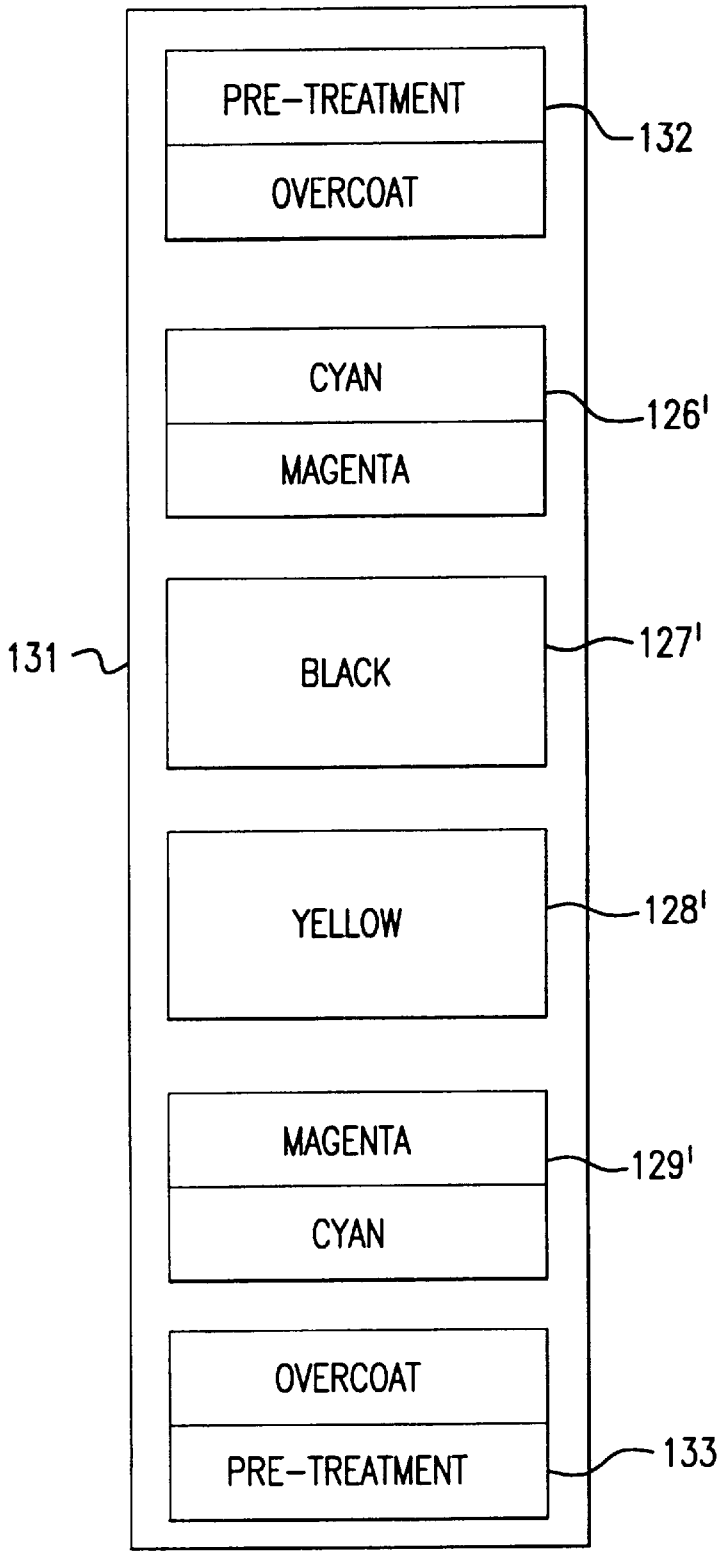

FIG. 19 diagrammatically illustrates a bi-directional carriage 131 for color printing similar to the carriage 125, FIG. 18 with the addition of two print cartridges 132, 133 at either end. In print cartridge 132 in the outer pressure regulator/array of nozzles is a pretreatment compound such as polyethyleneimine (PEI). The pretreatment compound is jetted on to the printing media in front of or before the ink droplets to prepare the media for the ink. The function of this compound is to make the media independent of the ink and the image that is produced by the inks unaffected by the media used. Located in the inner pressure regulator/array of nozzles is a overcoat compound such as Styrene-maleric anhydride (SMA). The overcoat compound is jetted on the printing media after the ink droplets have been jetted and the image is formed. The function of the overcoat compound is to make the image more permanent, i.e., more light fast, smudge proof, or water proof. The overcoat compound can also encapsulate the colorants in the ink.

Figure 20:
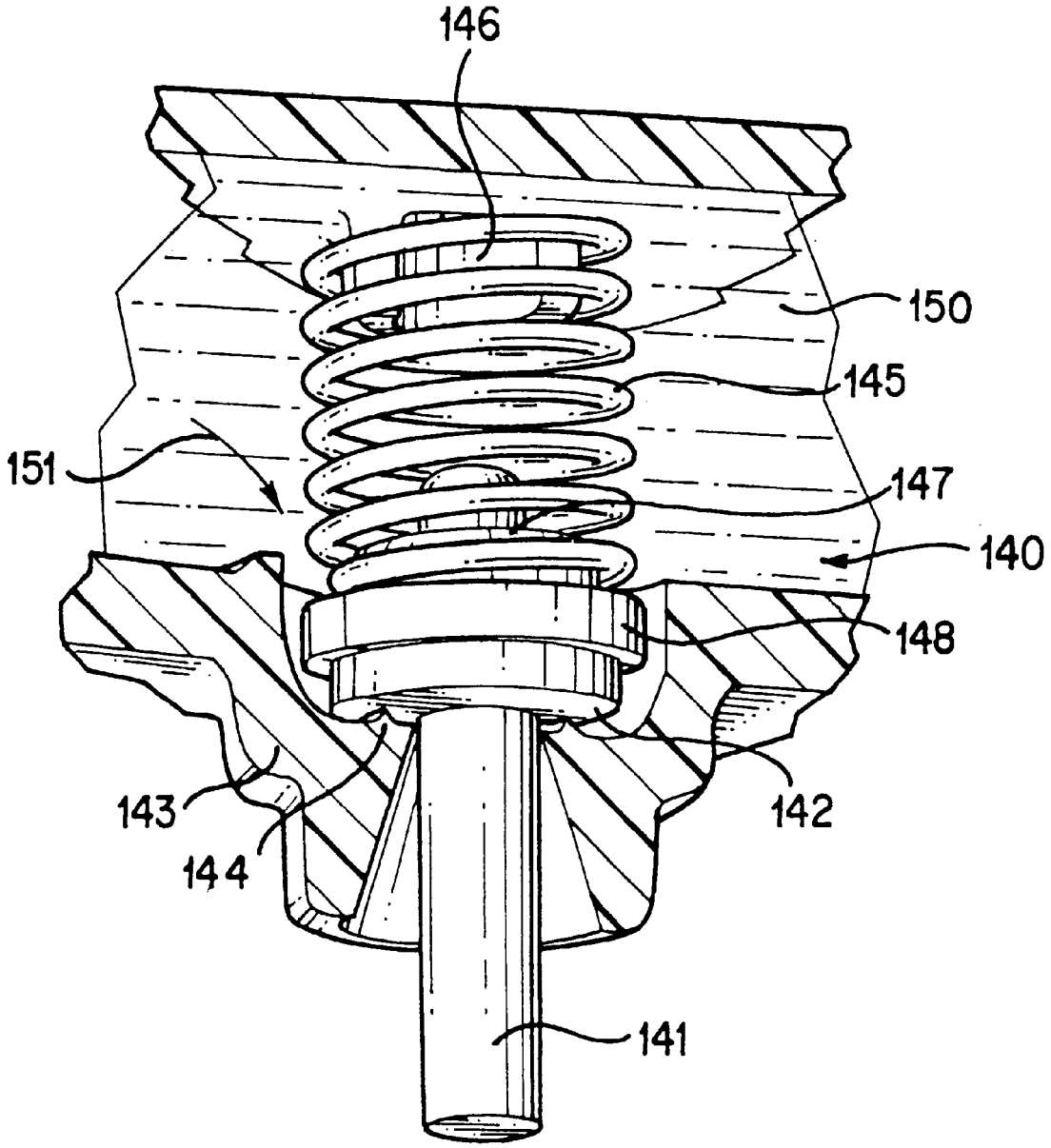
FIG. 20 is a perspective view from below of an alternative embodiment of the valve assembly of FIG. 10.

Referring to FIG. 20, reference numeral 140 generally indicates an alternative embodiment of the inlet valve assembly 81, FIGS. 9, 10, and 11. The inlet valve assembly includes a stem 141 that is elongate, rigid, and actuated by the pressure plate 71, FIG. 4 in the same manner as described above. Orthogonal to the stem 141 and molded thereto is an elastomeric valve disk 142. The valve disk is cylindrical, resiliently deformable, and fabricated from silicone rubber. The stem 141 and valve disk 142 are received in a valve pocket in a valve body 143. The valve pocket is circular and contains a central opening through which the stem descends. Around the rim of the central opening and molded in the valve body 143 is a circular valve seat 144. The valve disk 142 seals against the valve seat 144 forming a fluidic seal. The valve disk is urged against the valve seat by a valve spring 145 acting in compression. The valve spring is retained in place by a spring retainer 146 located in the top wall above the valve disk 142 that engages the inside diameter of the valve spring. The lower portion of the valve spring 145 is retained in position by an elongate extension 147 of the stem 141. The stem and its extension are coaxial along a common longitudinal axis. The valve spring 145 engages a rigid spring stop 148 that is orthogonal to the stem 141 and forms a single unitary molded LCP part with the stem 141 and its extension 147. The elastomeric cylindrical valve disk 142 is bonded or overmolded to the bottom of the spring stop 148. The valve seat 144 engages the valve disk 142 on the same side as the stem 141 is attached.

In operation, the valve assembly 140, FIG. 20 sits normally shut with the valve disk 142 being urged against the valve seat 144 by the valve spring 145. This is the normal non-printing condition. The area above the valve pocket and the valve body 143 is filled with ink 150 at some pressure above the pressure below the valve disk 142 and within the regulator housing 54, FIG. 4. When the pressure plate 71 engages the stem 141 and actuates the valve assembly 140, the valve disk 142 pivots on a section of the valve seat 144 and unseals an other section of the valve disk 142, normally, diametrically opposite. The ink 150 then flows downward between the valve disk and the valve seat in the space just opened up. This flow is indicated by the arrow 151. When the pressure in the regulator housing 54 returns to normal, the valve assembly shuts in the reverse of the process described above. The tilting back and forth of the valve disk 142 on the valve seat 144 and the filling of the regulator with ink are steps that are repeated over and over again order to provide ink to the back of the print head 41 at the desired operating pressure.

Although specific embodiments of the invention have been described and illustrated, the invention is not to be limited to the specific forms or arrangement of parts so described and illustrated. The invention is limited only by the claims.

We claim:

1. A valve assembly in a back pressure regulator for an ink jet print head, comprising:

a) a unitary valve having an elongate stem, a valve seat pocket attached thereto, and an elastomeric valve seat bonded onto the pocket;

b) an axle supporting the valve and about which the valve rotates; and c) a valve nozzle, operatively connected to the valve, either blocked or unblocked by the valve seat through rotation of the valve about the axle.

2. The apparatus of claim 1 wherein the axle has an axis of rotation and the axis is parallel to a tangent of the pocket.

3. A valve assembly in a back pressure regulator for an ink jet print head, comprising:

a) a valve having an elongate stem and an elastomeric disk attached thereto;

b) a valve body having an opening through which the stem extends and a valve seat surrounding the opening; and c) a valve spring which urges the elastomeric disk against the valve seat in a sealing relationship so that when the stem is actuated, the disk tilts on a section of the valve seat and unseals another section of the valve seat.

4. The apparatus of claim 3 wherein the section of the valve seat where the disk tilts is diametrically opposite to the section of the valve seat where the disk unseals.

5. The apparatus of claim 3 wherein the valve seat engages the elastomeric disk on the same side as the stem is attached.

* * * * *